United States Patent [19]

Hartley et al.

[11] Patent Number: 4,827,831

[45] Date of Patent: May 9, 1989

[54] RECIPROCATING DEVICE AND SWITCHING MECHANISM THEREFOR

[75] Inventors: E. Dale Hartley, Malibu; F. Scott Hartley, Camarillo, both of Calif.

[73] Assignee: Product Research And Development, Santa Ana, Calif.

[21] Appl. No.: 139,377

[22] Filed: Dec. 30, 1987

[51] Int. Cl.[4] ..... F01L 15/14; F01L 23/00

[52] U.S. Cl. ..... 91/237; 91/268; 91/272; 91/329; 91/341 A; 91/350; 137/625.27

[58] Field of Search ..... 91/237, 268, 271, 272, 91/329, 341 R, 341 A, 344, 350, 410, 469; 137/442, 106, 625.27

[56] References Cited

U.S. PATENT DOCUMENTS

| | | | |
|---|---|---|---|
| 2,925,782 | 2/1960 | Sharpe et al. | 91/350 X |
| 3,236,441 | 2/1966 | Russell | 91/329 X |
| 3,794,075 | 2/1974 | Stoll et al. | 137/625.27 X |
| 4,393,749 | 7/1983 | Miyazaki | 91/376 R |
| 4,610,192 | 9/1986 | Hartley et al. | 91/341 R |
| 4,674,958 | 6/1987 | Igarashi et al. | 91/341 A X |

FOREIGN PATENT DOCUMENTS

| | | | |
|---|---|---|---|
| 129665 | 1/1985 | European Pat. Off. | 137/625.27 |
| 471139 | 2/1929 | Fed. Rep. of Germany | 91/329 |
| 275969 | 10/1980 | Fed. Rep. of Germany | 91/329 |

*Primary Examiner*—Robert E. Garrett
*Assistant Examiner*—M. Williamson
*Attorney, Agent, or Firm*—Gordon L. Peterson

[57] ABSTRACT

A reciprocating device comprising a housing having a chamber and a reciprocable member reciprocable in the chamber. First and second pressure valves are connectible to a source of fluid under pressure to drive the reciprocable member and first and second passages lead from the first and second pressure valves to the chamber on opposite sides of the reciprocable member, respectively. First and second exhaust valves are coupled, respectively, to the first and second passages at locations intermediate the associated pressure valve and the chamber and communicating with the first and second vents, respectively. Actuators are drivable by the piston for switching the valves between first and second positions, and the fluid under pressure retains the valves in whichever of the positions they are placed.

14 Claims, 5 Drawing Sheets

DRIVING FLUID
25
37
45
43
13
11
49
62
31
62
47
15
17
21
41
43
23
35
55
61
63
63
51
65
53
61
67
39
77
81
93
33
91
19
34
69
83
79
75
97
36
32
27
95

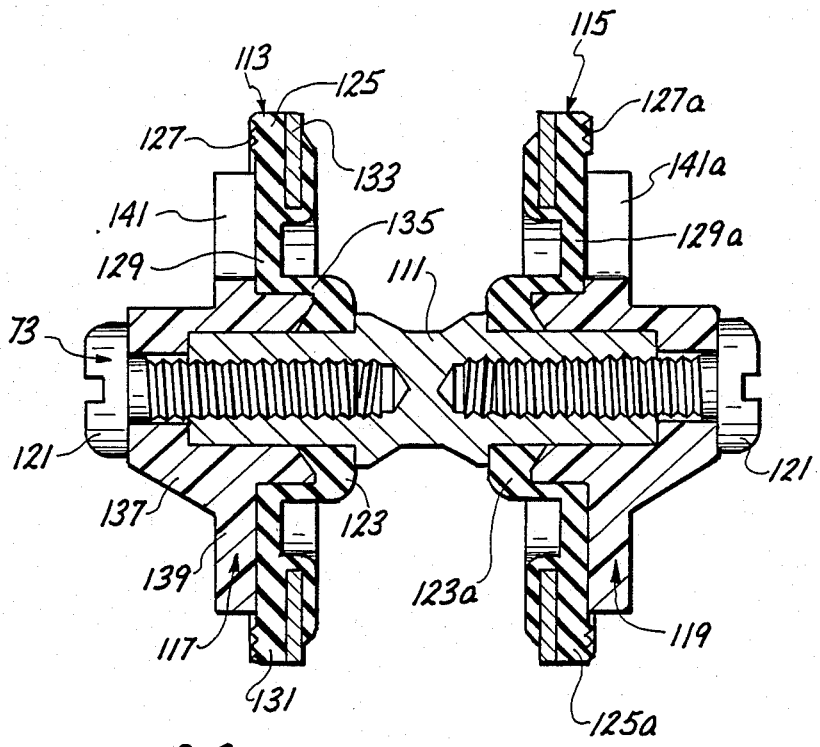
Fig. 2A
Fig. 2B
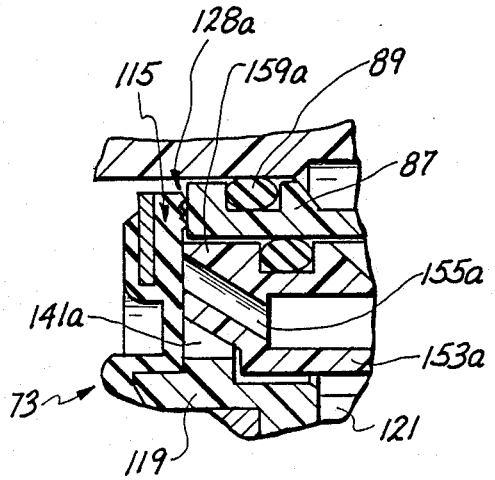

RECIPROCATING DEVICE AND SWITCHING MECHANISM THEREFOR

BACKGROUND OF THE INVENTION

Reciprocable devices have application in both the generation and utilization of power. For example, certain motors and positive displacement pumps and compressors utilize a reciprocable member which may be, for example, a piston or diaphragm.

Fluid, i.e., liquid or gas, under pressure can be used to reciprocate the reciprocable member. One problem with using fluid under pressure to reciprocate a reciprocable member is getting the reciprocable member to properly reverse its direction at the end of each stroke and not stall. A related problem is being able to start the reciprocable member moving along one of its strokes regardless of the position of the reciprocable member at startup. In this regard; a reciprocable device may be shut off with the reciprocable member in any position along its path of travel, and accordingly, restarting of the reciprocable device must be possible regardless of the location of the reciprocable member.

To reciprocate a reciprocable member, fluid under pressure is alternately supplied to the opposite sides of the piston, and the side of the piston which is not subjected to fluid under pressure is vented or exhausted. These functions are typically accomplished by a switching mechanism which comprises a pressure valve for controlling the flow of fluid under pressure and exhaust valves for controlling the exhausting process.

Reciprocating devices are shown, for example, in Hartley et al U.S. Pat. No. 4,610,192. The patented construction employs a bistable toggle mechanism which is driven just over center by energy from the piston and then driven by stored spring energy. The toggle action reverses the pressure and exhaust valves to bring about a reversal of movement of the reciprocable member.

Although these patented constructions are most satisfactory for many applications, it has been found that, for high-pressure applications, a strong spring must be used to assure switching of the valves. This relatively high spring force holds the reciprocable member in either of two positions even when the device is not in use, and as a consequence, the seating surfaces of the valves tend to take an undesirable permanent set.

SUMMARY OF THE INVENTION

This invention solves the problems noted above in providing a reciprocating device which is not subject to stalling at the end of a stroke and which can be started regardless of the position of the reciprocable member along its stroke at startup. In addition, this invention eliminates the bistable toggle device of the prior art and generally provides a simpler, less expensive, easier to assemble switching mechanism for reversing the reciprocable member. Although the switching mechanism of this invention is bistable, it is not held in position by springs so that during periods of non-use, the relevent seating surfaces are not under load. During use, only fluid under pressure is used to hold the switching mechanism in its two positions.

The invention may be embodied in, for example, a reciprocating device which includes a housing having a chamber therein and a reciprocable member reciprocable in the chamber. First and second pressure valves are connectible to a source of fluid under pressure to drive the reiiprocable member, and first and second passages lead from the first and second pressure valves to the chamber on opposite sides of the reciprocable member, respectively. First and second exhaust valves are coupled, respectively, to the first and second passages at locations intermediate the associated pressure valve and the chamber, and these exhaust valves communicate with first and second vents, respectively. Means drivable by the reciprocable member switches the valves between first and second positions, and accordingly, the valves are bistable. Fluid pressure responsive means retains the valves in the first and second positions.

With this construction, fluid under pressure from the source has two separate paths leading to the two vents. In practice, it is not possible that these two paths will present the same pressure drop to the flowing gas, and this is used to assure proper startup when the reciprocable device is not pressurized and both exhaust valves are open. With this invention, the path with the greater pressure drop provides the force necessary to accomplish switching of the valves so start up can be accomplished.

The valves preferably include first and second pressure valve seats and first and second exhaust valve seats and a reciprocable shuttle including first and second pressure valve members engageable, respectively, with the first and second pressure valve seats and first and second exhaust valve members engageable, respectively, with the first and second exhaust valve seats. The shuttle is reciprocable between first and second positions to place the valves in the first and second positions thereof, respectively.

The means drivable by the reciprocable member includes a substantially rigid drive connection, such as an actuator, between the piston and the shuttle. This eliminates the toggle mechanism used heretofore to drivingly couple the piston or other reciprocable member to the switching mechanism.

The shuttle may advantageously include a core, and the first exhaust valve member is coupled to the core and extends outwardly of the core. The first exhaust valve member has a resilient web and a seating surface radially outwardly of the web which is engageable with the first exhaust valve seat in the second position. The resilient web enables the first exhaust valve to open before the opening of the second pressure valve.

The resilient web absorbs tolerances during seating of the exhaust valve and the associated second pressure valve. Preferably, the first exhaust valve and the second pressure valve are constructed and arranged so that, in switching from one position to the other, the first exhaust valve closes before the second pressure valve. The resilient web allows this to occur.

It is desirable, although not necessary, to employ a relatively rigid member carried by the first exhaust valve member radially outwardly of at least a portion of the resilient web to stiffen a zone of the first exhaust valve member adjacent the seating surface which engages the exhaust valve seat. The relatively rigid member facilitates rapid opening and closing of the exhaust valve by tending to make the region of the exhaust valve adjacent the seating surface less subject to discontinuities. The rigid member also keeps the exhaust valve from collapsing under higher differential pressure loads.

The shuttle also preferably includes a relatively rigid retainer member carried by the core closely adjacent the first exhaust valve member on the same side of the exhaust valve member as the seating surface. This provides rigidity for fast stripping of the exhaust valve member away from the exhaust valve seat but does not interfere with the flexibility of the resilient web during seating of the exhaust valve.

Because the first exhaust valve unseats before the second pressure valve opens, it is desirable to close the first vent before the first exhaust valve is opened to prevent the massive escape of the fluid under pressure if the reciprocable device should stop at that moment due to a shutting down of the reciprocating device. If the fluid under pressure is carbon dioxide, as is often the case with beverage pumps, the continuous escape of $CO_2$ can be hazardous and is potentially deadly to those breathing it.

To accomplish this, this invention provides an auxiliary exhaust valve for blocking communication between the first vent and the first exhaust valve prior to opening of the first exhaust valve. In addition, an exhaust chamber is provided between the first exhaust valve and the first vent, and the auxiliary exhaust valve allows communication between the first exhaust valve and the first exhaust chamber. Consequently, opening of the first exhaust valve provides an exhaust chamber which serves as an expansion chamber to provide some pressure equalization across a portion of the shuttle but does not provide a path between the source of fluid under pressure and the first vent which could be both costly and hazardous. The pressure equalization allows the fluid forces acting on the shuttle to accomplish switching of the valves even if the reciprocable member has stopped.

In a preferred construction, the actuator has a passage extending therethrough in communication with the first vent, and this passage is blocked off by the first exhaust valve member when the actuator engages the first exhaust valve member to move the first exhaust valve member off of the exhaust valve seat. Also, the actuator and the shuttle may be used to at least partially define the exhaust chamber.

The invention, together with additional features and advantages thereof, may best be understood by reference to the following description taken in connection with the accompanying illustrative drawing.

BRIEF DESCRIPTION OF THE DRAWING

FIG. 2A is a view similar to FIG. 2 illustrating the shuttle.

FIG. 2B is a fragmentary, sectional view illustrating the blocking off of one of the passages leading to exhaust.

DESCRIPTION OF THE PREFERRED EMBODIMENT

Figure 1:
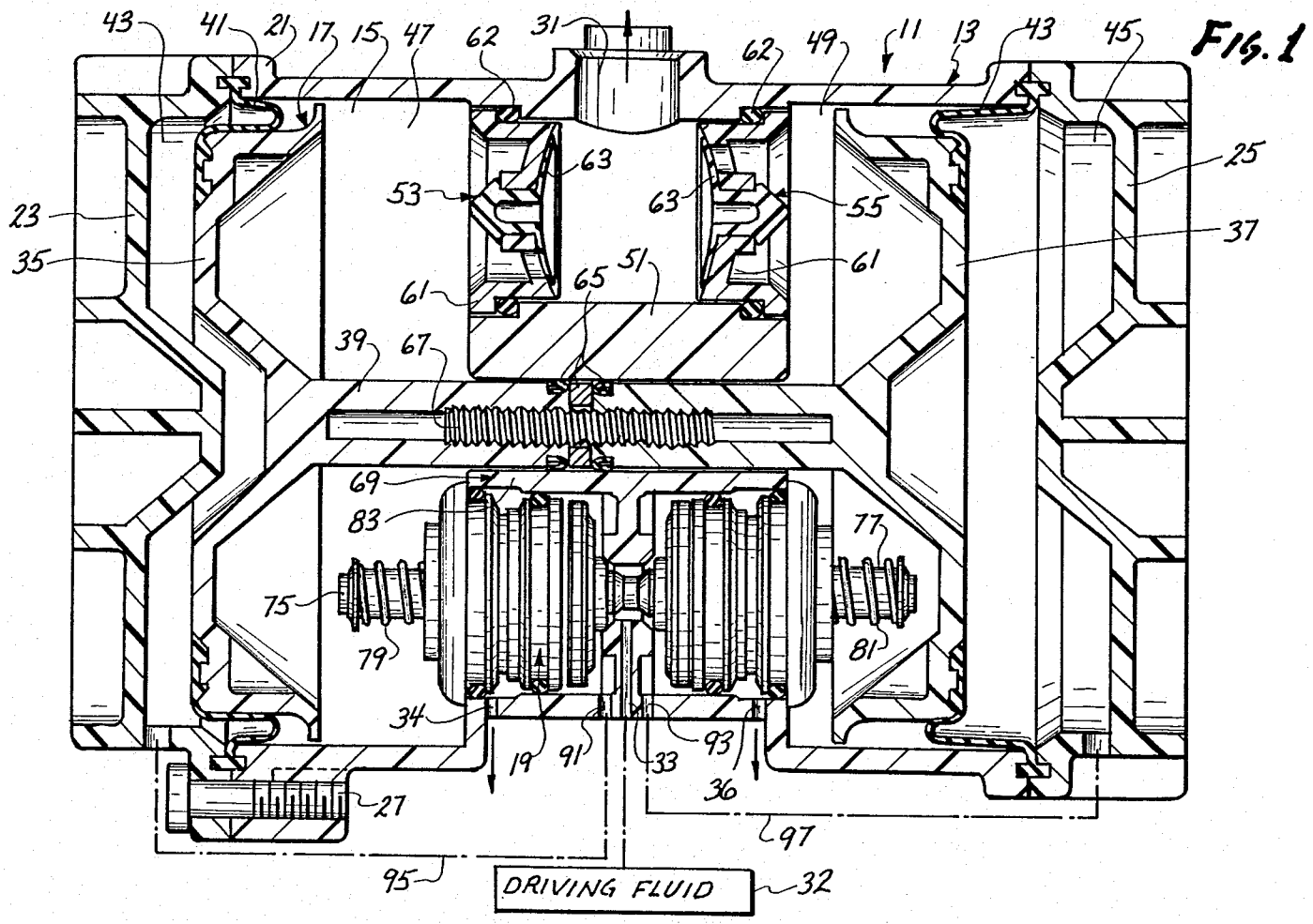
FIG. 1 is an axial sectional view through one form of reciprocating device constructed in accordance with the teachings of this invention.

FIG. 1 shows a reciprocating device in the form of a pump 11 which includes a housing 13 having a chamber 15 therein a reciprocable member in the form of a double-acting piston 17 and a switching device 19 carried by the housing. Although the pump 11 may pump various different liquids, in this embodiment, it is a beverage pump and is particularly adapted for pumping of a soft drink syrup or beverage concentrate.

Although the housing 13 can be of various different constructions, in this embodiment, it includes a main body 21 in the form a sleeve and end caps 23 and 25 suitably interconnected as by screws 27 (only one being shown in FIG. 1). The housing 13 has a liquid inlet 29 (FIG. 5) connectible to a source of liquid 30, such as a beverage component, to be pumped and a liquid outlet 31 through which the liquid is delivered at an increased pressure. The housing 13 also has a pressure inlet 33 connectible to a source 32 of driving fluid under pressure to drive the piston 17. The driving fluid is preferably a gas, such as air or carbon dioxide. The housing 13 also has exhaust or vent outlets 34 and 36 at atmospheric pressure.

Figure 5:
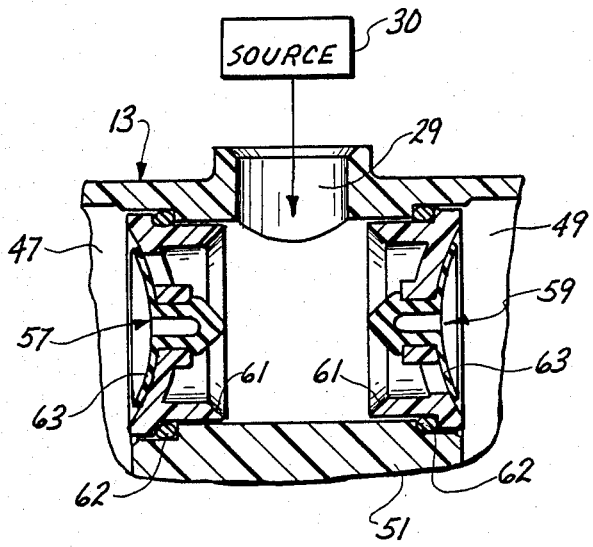
FIG. 5 is a fragmentary, sectional view taken through an axial plane different from the axial plane of FIG. 1 and illustrating one form of inlet valve for the reciprocating device.

The piston 17 in the illustrated embodiment is a double-acting piston and includes piston sections 35 and 37 joined by a connecting rod 39. Annular rolling diaphragms 41 and 43 seal the interfaces between the main body 21 and the end caps 23 and 25, respectively, and form a seal between the housing 13 and the associated piston sections 35 and 37. This provides sealed driving chambers 43 and 45 at the opposite ends of the piston 17 and sealed pumping chambers 47 and 49 between the piston sections 35 and 37. The pumping chambers 47 and 49 are sealed from each other by suitable structure, including a partition 51 of the housing 13, outlet check valves 53 and 55 and inlet check valves 57 and 59 (FIG. 5). Although the check valves 53, 55, 57 and 59 can be of various different constructions, in this embodiment, each of them includes a valve seat 61 suitably mounted in the partition 51 and sealed by seals 62 and a flexible, resilient valve element 63 mounted on the valve seat.

As shown in FIG. 1, the connecting rod 39 passes through a bore in the partition 51 and is sealed to the partition by annular seals 65. Although various different constructions may be employed, in this embodiment, the rod 39 is constructed in two sections and held together by an internal threaded stem 67.

With this construction, gas under pressure enters the pressure inlet 33 and is directed, for example, by the switching device 19 to the driving chamber 45 while the driving chamber 43 is open to exhaust or vent via the exhaust or vent outlet 34 to thereby drive the piston 17 to the left as viewed in FIG. 1. This enables the pump 11 to draw liquid to be pumped through the inlet 29 and the inlet check valve 57 (FIG. 5) into the pumping chamber 47 while the piston section 37 pumps the fluid to be pumped out of the pumping chamber 49 through the outlet check valve 55 and the outlet 31. When the piston 17 reaches the end of its stroke, the switching device 19 supplies the driving fluid under pressure from the pressure inlet 33 to the driving chamber 43 and opens the driving chamber 45 to exhaust to thereby cause the piston 17 to reverse its travel. Consequently, liquid in the pumping chamber 47 is discharged through the outlet 31 while the pumping chamber 49 is being enlarged on the intake stroke of the piston section 37 to take liquid to be pumped into the pumping chamber 49 through the inlet 29.

The basic operation of a double-acting piston pump is known and is disclosed, for example, Hartley U.S. Pat. No. 4,610,192. However, the present invention employs the novel switching device 19 which greatly improves the operation of a variety of reciprocating devices of which the pump 11 is illustrative.

Figure 2:
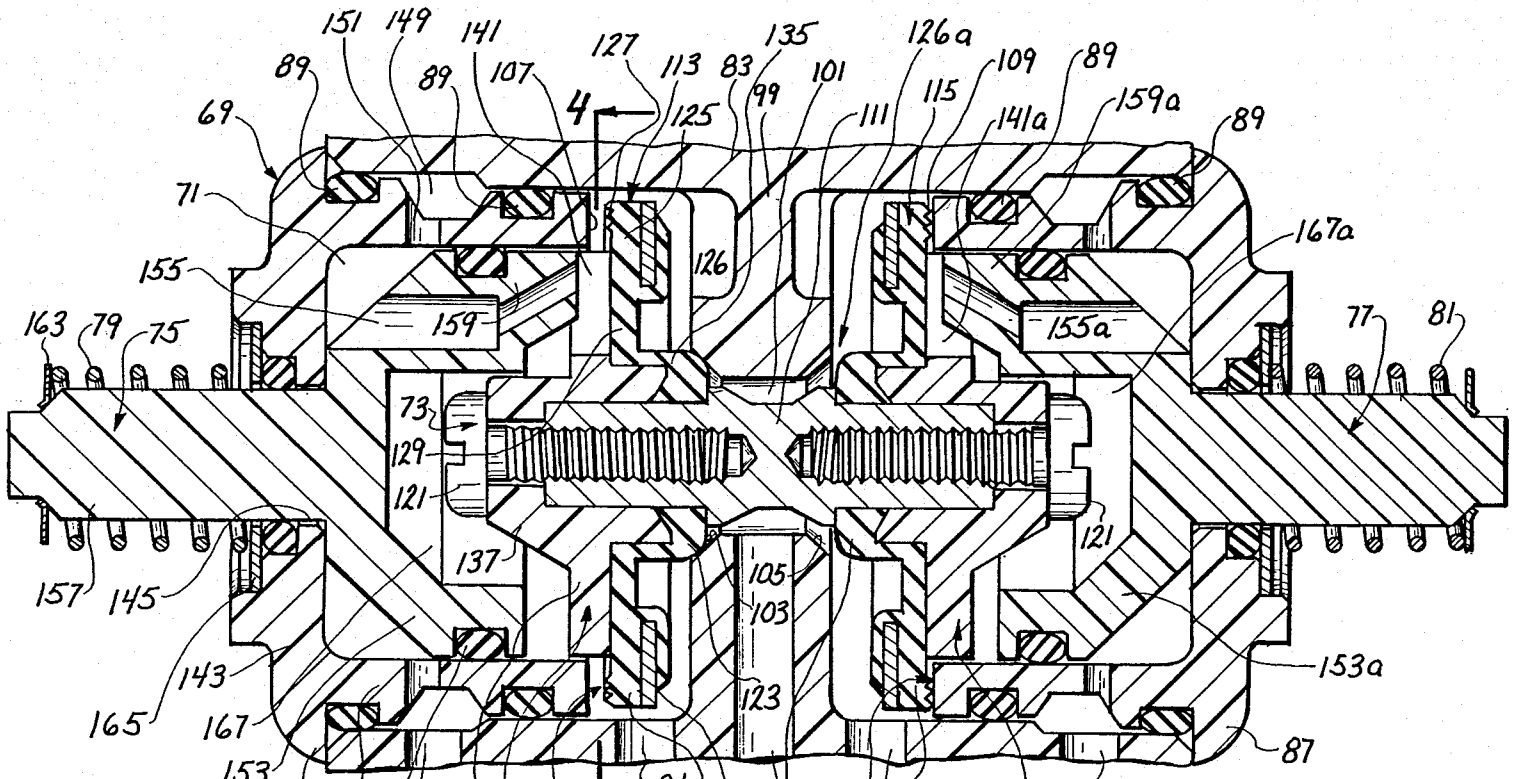
FIG. 2 is a longitudinal sectional view through a preferred form of valve-switching mechanism.

With reference to FIG. 2, the switching device 19 includes a switching device housing 69 having a shuttle chamber 71 therein, a shuttle 73 (FIG. 2A) reciprocable in the shuttle chamber 71 and actuators 75 and 77 at opposite ends of the shuttle chamber and biased outwardly by springs 79 and 81, respectively. Although the switching device housing 69 may be constructed in different ways and may be entirely separate from the pump housing 13, in this embodiment, the switching device housing 69 has a peripheral wall 83 (FIGS. 1 and 2) which is provided by the pump housing 13 and opposite end walls 85 and 87 sealed to the peripheral wall 83 by annular seals 89 and suitably attached to the peripheral wall 83. The switching device housing 69 has pressure outlets 91 and 93 and communicates with the pressure inlet 33 and the exhaust outlets 34 and 36. The pressure outlets 91 and 93, like the exhaust outlets 34 and 36, are formed in the housing 13. As shown diagrammatically in FIG. 1, the pressure outlets 91 and 93 are coupled by suitable conduits or passages 95 and 97 to opposite sides of the piston 17 and specifically to the driving chambers 43 and 45, respectively.

The switching device housing 69 has a partition 99 that separates the shuttle chamber 71 into two separate sections, and the pressure inlet 33 extends through the partition 99 to an opening 101 extending through the partition. The partition 99 provides annular pressure valve seats 103 and 105 at opposite ends of the opening 101, and the end walls 85 and 87 terminate inwardly within the shuttle chamber 71 in annular exhaust or exhaust valve seats 107 and 109.

The shuttle 73 (FIG. 2A) includes an elongated core 111 having axially extending, open, threaded sockets at its opposite ends, valve elements 113 and 115, relatively rigid retainer members 117 and 119 and screws 121 for attaching the valve elements and retainer members to the core. The valve elements 113 and 115 and the retainer members 117 and 119 are identical, and accordingly, only the valve element 113 and the retainer member 117 are described in detail. Portions of the valve element 115 and the retainer member 119 corresponding to portions of the valve element 113 and the retainer member 117 are designated by corresponding reference numerals followed by the letter "a."

The valve element 113 includes a pressure valve member 123 and an exhaust or vent valve member 125. The pressure valve member 123 has a rounded surface engageable with the pressure valve seat 103 as shown in FIG. 2 to form a pressure valve 126, and the exhaust valve member 125 lies radially outwardly of the core and has a seating surface 127, which may comprise a plurality of circumferentially extending ribs, engageable with the exhaust valve seat 107 to form an exhaust valve 128. The exhaust valve member 125 also has a resilient web 129 extending radially outwardly and an enlarged head 131 coupled to the web and having the seating surface 127 thereon. The seating surface 127 lies radially outwardly of the web 129.

The valve element 113 also includes an annular, relatively rigid member 133 of metal or other suitable material embedded in and carried by the head 131. The member 133 is a washer-like member and lies radially outwardly of the resilient web 129 to stiffen a zone of the exhaust valve member. Specifically, in the illustrated embodiment, this zone is the head 131, except for a narrow radial inward zone of the head. A portion of the member 133 is in axial alignment with the seating surface 127 so it can tend to hold the seating surface 127 in the desired configuration and resist undesired distortion of the seating surface.

Except for the member 133, the valve element 113 may be constructed of a suitable plastic material. Although the pressure valve member 123 and the exhaust valve member 125 can be structurally separate members, it is preferred to provide them on the single valve element 113 and interconnect them with an annular region 135 of the valve element 113.

Figure 4:
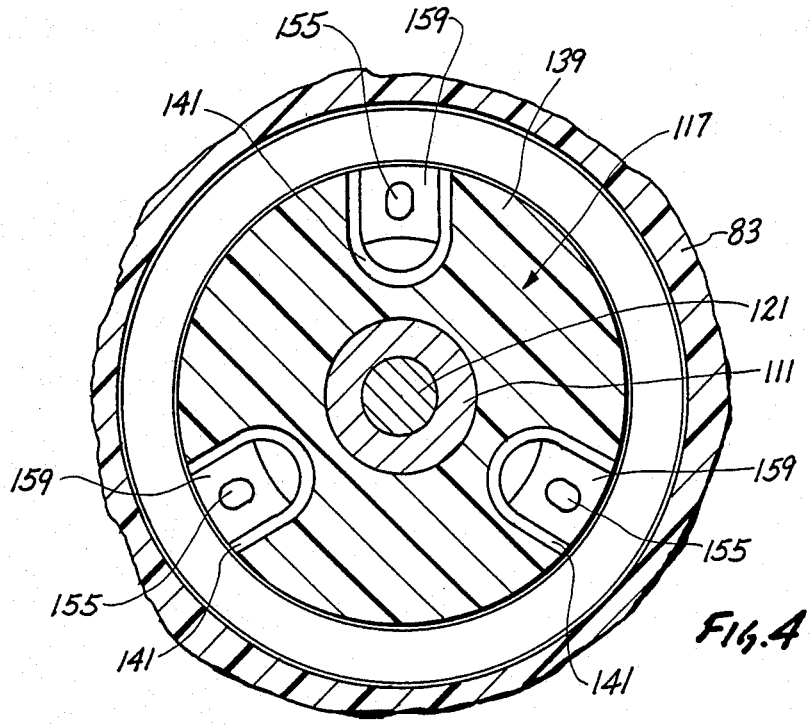
FIG. 4 is a sectional view taken generally along line 4—4 of FIG. 2.

The retainer member 117 has a central tubular section 137 and a circumferentially extending flange 139 joined to the central section. As best seen in FIG. 4, the flange 139 has three slots 141 equally spaced circumferentially and opening at the outer periphery of the flange 139. The retainer member 117 is relatively rigid and is preferably constructed of a relatively rigid plastic material. As such, the retainer member 117 is substantially stiffer than the web 129.

As shown in FIG. 2, the screws 121 extend through openings in the valve elements 113 and 115 and the retainer members 117 and 119 to attach these components to the core 111. In addition, the inner end of the retainer member 117 snugly fits within the annular region 135.

The end walls 85 and 87 are identical and so are the actuators 75 and 77. Accordingly, only the end wall 85 and the actuator 75 are described in detail herein, and portions of the end wall 87 and the actuator 77 corresponding to portions of the end wall 85 and the actuator 75 are designated by corresponding reference numerals followed by the letter "a."

The end wall 85 includes a transverse wall 143 having a central opening 145 and a peripheral wall 147 having an external annular groove 149 and a plurality of openings 151 extending through the peripheral wall into the groove. The transverse wall 143 covers the end of the shuttle chamber 71, and the peripheral wall 147 is received within the shuttle chamber 71 with the groove 149 confronting the exhaust outlet 34. Opposite sides of the exhaust outlet 34 are sealed by the seals 89 as shown in FIG. 2.

The actuator 75 comprises a plunger 153 having three passages 155 (FIGS. 2 and 4) extending through it and an axially extending stem 157 integrally coupled to the plunger 153 and projecting through the opening 145. The plunger 153 has three projections or feet 159 that project into the slots 141, respectively, as shown in FIGS. 2 and 4. The passages 155 extend through the plunger 153 and the feet 159, respectively. The plunger 153 is slidably receivable within the peripheral wall 147 and is sealed to the peripheral wall by an annular seal 161.

The spring 79 acts against retainers 163 and 165 carried by the outer end of the stem 157 and the end wall 5, respectively, to bias the actuator 75 outwardly, i.e., to the left as viewed in FIG. 2. The plunger 153 abuts the transverse wall 143 adjacent the opening 145 to limit the outward movement of the actuator 75. The actuator 75 is substantially rigid longitudinally and is engageable by the piston 17 and drivable by the piston.

With this construction, there is an exhaust chamber 167 in communication with the exhaust valve seat 107 in the position of the shuttle 73 shown in FIG. 2. In this embodiment, the exhaust chamber 167 is defined by the shuttle 73, the peripheral wall 147 and the actuator 75, or more specifically, the portion of the actuator represented by the plunger 153.

With the shuttle 73 in the position of FIG. 2, the pressure valve member 123 and the exhaust valve member 125*a* are in engagement with the pressure valve seat 103 and the exhaust valve seat 109, and the pressure valve member 123*a* and the exhaust valve member 125 are out of engagement with the pressure valve seat 105 and the exhaust valve seat 107, respectively. Consequently, driving fluid under pressure from the source 32 flows through the pressure inlet 33, past the pressure valve member 123*a* and through the pressure outlet 93 and the conduit 97 to the driving chamber 45. Also, the driving chamber 43 is open to the exhaust outlet 34 through the conduit 95, the pressure outlet 91, the spaced apart exhaust valve member 125 and associated exhaust valve seat 107, the exhaust chamber 167, the passages 155, the openings 151 and the groove 149. Consequently, the piston 17 is driven to the left as viewed in FIG. 1 so that liquid under pressure from the pumping chamber 49 is discharged through the outlet 31 while fluid to be pumped from the source of liquid 30 (FIG. 5) is drawn into the pumping chamber 47.

The shuttle 73 is held in the position of FIG. 2 by the fluid pressures acting on the shuttle. More specifically, the driving fluid under pressure from the pressure inlet 33 acts against the entire lefthand face of the valve element 115 to create the primary force for holding the shuttle 73 in the position of FIG. 2.

Figure 3:
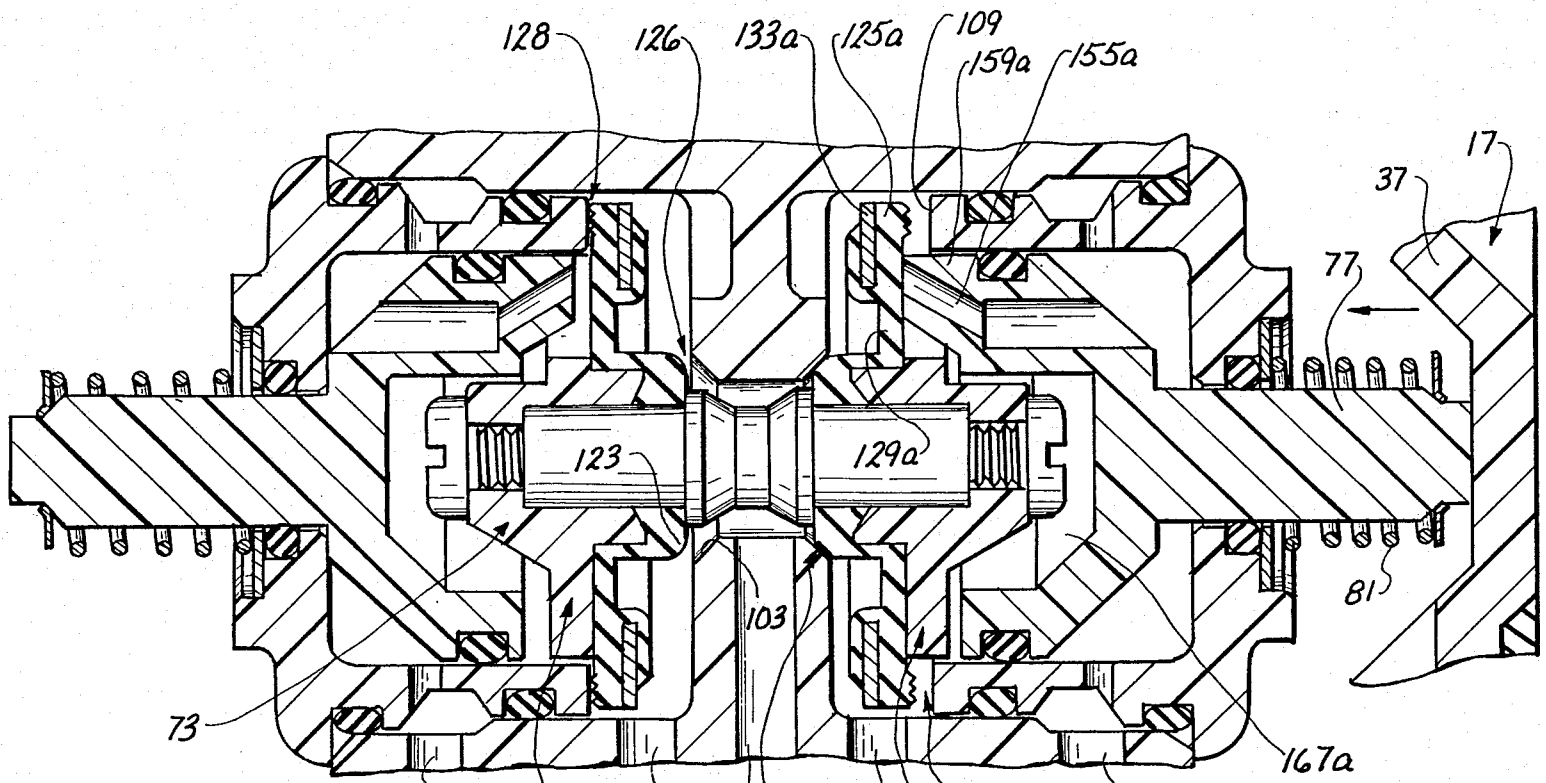
FIG. 3 is a sectional view similar to FIG. 2, with the valve-switching mechanism being in the other of its two positions.

The movement of the piston 17 to the left will eventually bring the piston section 37 into contact with the actuator 77, and this will move the actuator 77 to the left as viewed in FIGS. 1, 2 and 3 against the biasing action of the spring 81. After traveling only a very short distance, the feet 159*a* contact the exhaust valve member 125*a* to seal or block off the passages 155*a* as shown in FIG. 2B. This seals off or closes the exhaust outlet 36 from the pressure inlet 33 because the passages 155*a* are in the fluid pathway between the inlet 33 and the outlet 36. The material of the exhaust valve member 125*a* at the region of contact with the feet 159*a* is sufficiently soft to serve as a valve seat to close the passages 155*a*.

The next incremental movement of the actuator 77 to the left forces the exhaust valve member 125*a* off of the exhaust valve seat 109 and pushes the shuttle 73 to the left to the position shown in FIG. 3. This opens a path from the pressure inlet 33 to the driving chamber 43 across the pressure valve member 123 and through the pressure outlet 91 and opens the driving chamber 45 to the exhaust chamber 167*a* via the pressure outlet 93 and the open exhaust valve 128*a*. Although the exhaust chamber 167*a* is a sealed chamber, it has sufficient volume to relieve the pressure within the driving chamber 45 sufficiently to allow the driving fluid under pressure from the pressure inlet 33 to initiate movement of the piston 17 to the right. Slight movement of the piston 17 to the right allows the spring 81 to move the actuator 77 to the right from the position shown in FIG. 3 to separate the feet 159*a* from the exhaust valve member 125*a* to open the passages 155*a*. This establishes communication with the exhaust outlet 36 so that the driving chamber 145 is now coupled to exhaust.

From the foregoing, it can be seen that the feet 159*a*, the passages 155*a*, and the exhaust valve member 125*a* serve as an auxiliary valve for blocking communication between the exhaust outlet 36 and the pressure inlet 33 before the exhaust valve element 125*a* is moved off of the exhaust valve seat 109 while allowing communication between the pressure outlet 93 and the exhaust chamber 167*a*. By so doing, the driving fluid from the source 32 is never allowed to escape through the exhaust outlet 36 as a result of opening the exhaust valve 128*a*.

The resilient web 129*a* performs several important functions relating to the switching of the valves 126, 126*a*, 128 and 128a between their open and closed positions. For example, when the exhaust valve member 125*a* is engaged firmly by the feet 159*a*, the resilient web 129*a* flexes to allow the exhaust valve 126*a* to open, i.e., to allow the exhaust valve member 125*a* to unseat from the exhaust valve seat 109 before the shuttle 73 is moved to open the pressure valve 126, i.e., to unseat the pressure valve member 123 from the pressure valve seat 103. The resilient, flexible web 129*a* is useful in tolerance absorption to assure that both the pressure valve member 123 and the exhaust valve member 125*a* will fully seat on their respective seats. The retainer member 119 helps to strip away the exhaust valve member 125*a* from the exhaust valve seat 109. However, the rigidity of the retainer member 119 does not interfere with seating of the exhaust valve member 125*a* because, when moving in the seating direction, the retainer member 119 can overtravel as may be required for complete closure of the exhaust valve 128*a* due to the flexibility of the resilient web 129*a*.

The member 133*a* helps in achieving rapid and full unseating of the exhaust valve member 125*a*. The member 133*a* is optional.

If the piston 17 were to stop with the shuttle 73 in the position of FIG. 2B, movement of the shuttle would also stop. However, if the piston 17 were to stop with the shuttle 73 slightly beyond the position of FIG. 2B so that there is some leakage through the exhaust valve 128*a*, the shuttle 73 would ultimately be moved by the driving fluid to the position of FIG. 3 to accomplish switching of the valves. The reason for this is that the leakage of pressure from the pressure inlet 33 into the exhaust chamber 167*a* would tend to balance the pressure across the righthand end of the shuttle 73 and the valve element 115 so that the driving fluid acting across the righthand face of the pressure valve member 123 would be sufficient to move the shuttle 73 to the left to the position shown in FIG. 3. Accordingly, the next time the pump 11 is started, the direction of movement of the piston 17 is reversed.

For normal start up of the pump 11, the shuttle 73 will be in the position of FIG. 2 or FIG. 3, and one or the other of the driving chambers 43 and 45 will be pressurized. So long as there is driving fluid under pressure applied to the pump 13 from the pressure inlet 33, the shuttle 73 will be in either the position of FIG. 2 or FIG. 3 regardless of the position of the piston 17 in the housing 13. Accordingly, start up of the pump 11 can be accomplished regardless of the position of the piston 17 so long as the pump 11 is subjected to the driving fluid under pressure from the source 32.

However, if the pump 11 is totally unpressurized, as for example when the pump 11 is first installed, the shuttle 73 may be at some position intermediate the positions of FIGS. 2 and 3. However, start up of the pump 11 can still be accomplished. The reason for this is that there are two separate paths from the pressure inlet 33 to the exhaust outlets 34 and 36, and in practice, there will be some pressure imbalance between these paths that will allow the fluid pressure to seat the shuttle 73 in one of its two positions.

Another feature of this invention is that the shuttle 73 can accomplish switching with a very short length of axial movement which may be, for example, of the order of 0.025 inch. The shuttle 73 is also very light-weight and requires only minimal force to move. These factors enable even small pressure differentials existing along the two separate paths from the pressure inlet 33 to the exhaust outlets 34 and 36 to move the shuttle 73 to one of its two positions.

Although an exemplary embodiment of the invention has been shown and described, many changes, modifications and substitutions may be made by one having ordinary skill in the art without necessarily departing from the spirit and scope of this invention.

We claim:

1. A reciprocating device comprising:

a housing having a chamber therein:

a reciprocable member reciprocable in the chamber;

first and second pressure valves connectible to a source of fluid under pressure to drive the reciprocable member;

means defining first and second passages leading from the first and second pressure valves to the chamber on opposite sides of the reciprocable member, respectively;

first and second exhaust valves coupled, respectively, to the first and second passages at locations intermediate the associated pressure valve and the chamber and communicating with first and second vents, respectively;

means drivable by the reciprocable member for switching the valves between a first position in which the first pressure valve and the second exhaust valve are closed and the second pressure valve and the first exhaust valve are open and a second position in which the first pressure valve and the second exhaust valve are open and the second pressure valve and the first exhaust valve are closed;

fluid pressure responsive means for retaining the valves in the first and second positions; and wherein in switching from the first position to the second position the drivable means engages the second exhaust valve to open the second exhaust valve before the first pressure valve is opened.

2. A reciprocating device comprising:

a housing having a chamber therein;

a reciprocable member reciprocable in the chamber;

first and second pressure valves connectible to a source of fluid under pressure to drive the reciprocable member;

means defining first and second passages leading from the first and second pressure valves to the chamber on opposite side of the reciprocable member, respectively;

first and second exhaust valves coupled, respectively, to the first and second passages at locations intermediate the associated pressure valve and the chamber and communicating with first and second vents, respectively;

means drivable by the reciprocable member for switching the valves between a first position in which the first pressure valve and the second valve are closed and the second pressure valve and the first exhaust valve are open and a second position in which the first pressure valve and the second exhaust valve are open and the second pressure valve and first exhaust valve are closed;

fluid pressure responsive means for retaining the valves in the first and second positions; and means for defining a first exhaust chamber between the first exhaust valve and the first vent, and auxiliary exhaust valve means for blocking communication between the first vent and the first exhaust valve prior to opening the first exhaust valve while allowing communication between the first exhaust valve and the first exhaust chamber.

3. A reciprocating device as defined in claim 2 wherein the first and second pressure valves include first and second pressure valve seats, respectively, and the first and second exhaust valves include first and second exhaust valve seats, respectively, said reciprocable device includes a reciprocable shuttle, said first and second pressure valves include first and second pressure valve members, respectively, included in the shuttle and engageable, respectively, with the first and second pressure valve seats, said first and second exhaust valves include first and second exhaust valve members, respectively, included in the shuttle and engageable with the first and second exhaust valve seats, respectively, said shuttle being reciprocable between first and second positions to place said valves in the first and second positions thereof, respectively.

4. A reciprocating device as defined in claim 3 wherein the fluid pressure responsive means includes surfaces of the shuttle.

5. A reciprocating device as defined in claim 3 wherein the means drivable by the piston includes a substantially rigid drive connection between the reciprocable member and the shuttle.

6. A reciprocating device as defined in claim 1 wherein the auxiliary exhaust valve means includes a portion of said drivable means.

7. A reciprocating device as defined in claim 1 wherein the first pressure valve and the second exhaust valve are constructed and arranged so that in switching from the second position to the first position the second exhaust valve closes before the first pressure valve.

8. A reciprocating device as defined in claim 1 wherein in switching from the first position to the second position the drivable means engages the second exhaust valve to open the second exhaust valve before the first pressure valve is opened.

9. A reciprocating device comprising:

a housing having a chamber therein:

a reciprocable member reciprocable in the chamber;

means for defining a shuttle chamber, said shuttle chamber having an inlet connectible to a source of fluid under pressure, first and second pressure outlets and first and second exhaust outlets;

means for defining first and second pressure valve seats and first and second exhaust valve seats in the shuttle chamber;

means for coupling the first and second pressure outlets to the chamber of the housing on opposite sides of the reciprocable member;

a shuttle reciprocable in said shuttle chamber and including first and second pressure valve members engageable, respectively, with the first and second pressure valve seats and first and second exhaust valve members engageable, respectively, with the first and second exhaust valve seats, said shuttle being reciprocable between a first position in which the first pressure valve member and the second exhaust valve member engage the first pressure seat and the second exhaust valve seat, respectively, and the second pressure valve member and the first exhaust valve member are spaced from the second pressure valve seat and the first exhaust valve seat, respectively, to block fluid flow from the inlet to the first pressure outlet and from the second pressure outlet to the second exhaust outlet and to provide communication between the inlet and the second pressure outlet and between the first pressure outlet and the first exhaust outlet and a second position in which the first pressure valve member and the second exhaust valve member are out of engagement with the first pressure valve seat and the second exhaust valve seat, respectively, and the second pressure valve seat and the first exhaust valve seat, respectively, to block fluid flow from the inlet to the second pressure outlet and from the first pressure outlet to the first exhaust outlet and to provide communication between the inlet and the first pressure outlet and between the second pressure outlet and the second exhaust outlet;

means drivable by the piston for switching the shuttle between said first and second positions thereof;

the shuttle having surfaces for cooperation with the fluid under pressure for retaining the shuttle in whichever of the first and second positions it is placed;

said drivable means including an actuator engageable with the shuttle to bring about switching of the shuttle; and said actuator having a passage extending therethrough in communication with the first exhaust outlet and said passage in said actuator being blocked off by the shuttle when the actuator engages the shuttle.

10. A reciprocating device as claimed in claim 9 wherein said shuttle includes a core, said first exhaust valve member is coupled to the core and extends outwardly of the core, said first exhaust valve member having a resilient web and a seating surface radially outwardly of the web which is engageable with the first exhaust valve seat in said second position.

11. A reciprocating device as defined in claim 10 including a relatively rigid member carried by said first exhaust valve member radially outwardly of at least a portion of the resilient web to stiffen a zone of the first exhaust valve member adjacent the seating surface.

12. A reciprocating device as defined in claim 10 including a relatively rigid retainer member carried by the core closely adjacent the first exhaust valve member on the same side of the exhaust valve member as the seating surface.

13. A reciprocating device as defined in claim 9 including means including the actuator and the shuttle for defining a first exhaust chamber in communication with the first exhaust valve seat in said first position and being out of communication with the first exhaust outlet when said passage in the actuator is blocked off by the shuttle .

14. A reciprocating device as defined in claim 9 wherein the actuator is substantially rigid longitudinally and is engageable by the piston and is drivable by the piston.

* * * * *

UNITED STATES PATENT AND TRADEMARK OFFICE

CERTIFICATE OF CORRECTION

PATENT NO. : 4,827,831

DATED : May 9, 1989

INVENTOR(S) : E. Dale Hartley et al

It is certified that error appears in the above-identified patent and that said Letters Patent is hereby corrected as shown below:

Column 10, line 1 after "second" insert -- exhaust --.

Signed and Sealed this

Nineteenth Day of May, 1992

*Attest:*

DOUGLAS B. COMER

*Attesting Officer*

*Acting Commissioner of Patents and Trademarks*